US011110512B2

(12) United States Patent
Dollhäubl et al.

(10) Patent No.: US 11,110,512 B2
(45) Date of Patent: Sep. 7, 2021

(54) METHOD AND DEVICE FOR REGULATING A CONTINUOUS CASTING MACHINE

(71) Applicant: Primetals Technologies Austria GmbH, Linz (AT)

(72) Inventors: Paul Felix Dollhäubl, Zwettl an der Rod (AT); Josef Watzinger, Reichenau im Muehlkreis (AT); Philipp Wieser, Schiedlberg (AT)

(73) Assignee: PRIMETALS TECHNOLOGIES AUSTRIA GMBH

( * ) Notice: Subject to any disclaimer, the term of this patent is extended or adjusted under 35 U.S.C. 154(b) by 87 days.

(21) Appl. No.: 16/466,313

(22) PCT Filed: Dec. 6, 2017

(86) PCT No.: PCT/EP2017/081615
§ 371 (c)(1),
(2) Date: Jun. 4, 2019

(87) PCT Pub. No.: WO2018/108652
PCT Pub. Date: Jun. 21, 2018

(65) Prior Publication Data

US 2019/0308238 A1 Oct. 10, 2019

(30) Foreign Application Priority Data

Dec. 13, 2016 (AT) ..... A 51133/2016

(51) Int. Cl.
*B22D 11/20* (2006.01)
*B22D 11/18* (2006.01)

(52) U.S. Cl.
CPC ..... *B22D 11/208* (2013.01); *B22D 11/18* (2013.01); *B22D 11/20* (2013.01)

(58) Field of Classification Search
CPC ..... B22D 11/18; B22D 11/20; B22D 11/208
(Continued)

(56) References Cited

U.S. PATENT DOCUMENTS 4,597,048 A * 6/1986 Mazur et al. ..... B22D 11/202 700/146
6,289,971 B1 9/2001 Kagawa ..... 164/449.01
(Continued)

FOREIGN PATENT DOCUMENTS

AT 413 023 B 10/2005
AT 518461 A1 10/2017
(Continued)

OTHER PUBLICATIONS

International Search Report dated Feb. 7, 2018 in corresponding PCT International Application No. PCT/EP2017/081615.
(Continued)

*Primary Examiner* — Kevin P Kerns
(74) *Attorney, Agent, or Firm* — Ostrolenk Faber LLP

(57) ABSTRACT

A method and a device for regulating a continuous casting system. The continuous casting system has a mold (1) and a strand guide (8) which is arranged downstream of the mold (1). Molten metal (3) is cast into the mold (1), in particular via an inlet device (4). The molten metal hardens on walls (1*a*) of the mold (1), such that a metal strand (7) with a hardened strand shell (5) and a still liquid core (6) is formed. The metal strand (7) is drawn out of the mold (1) by mutually spaced rollers (8*b*) of the strand guide (8), and a measurement variable is ascertained which correlates to the undulation of the casting level formed in the mold. The measurement variable is processed using at least one computing specification and is used to reduce the undulation of the casting level. In order to reduce the undulations of the casting level, the mutual spacing of opposing rollers (8*b*) of the strand guide is changed cyclically prior to the full hardening point (D).

17 Claims, 5 Drawing Sheets

(58) Field of Classification Search
USPC ..... 164/454, 484, 413, 441, 442, 447, 448
See application file for complete search history.

(56) References Cited

U.S. PATENT DOCUMENTS

| | | | | |
|---|---|---|---|---|
| 8,006,743 | B2 | 8/2011 | Weyer et al. | 164/452 |
| 8,302,664 | B2 | 11/2012 | Stavenow et al. | 164/442 |
| 2008/0308251 | A1* | 12/2008 | Weyer etal. | B22D 2/003 164/452 |
| 2011/0056803 | A1* | 3/2011 | Stavenow et al. | B22D 11/208 198/604 |

FOREIGN PATENT DOCUMENTS

| | | | | |
|---|---|---|---|---|
| CN | 1909995 | A | 2/2007 | |
| CN | 101426603 | A | 5/2009 | |
| CN | 101920316 | A | 12/2010 | |
| CN | 102046309 | A | 5/2011 | |
| CN | 103998160 | A | 8/2014 | |
| CN | 104275448 | A | 1/2015 | |
| DE | 197 45 547 | A1 | 6/1999 | |
| DE | 102 14 497 | A1 | 10/2001 | |
| DE | 10 2004 002 783 | A1 | 8/2005 | |
| DE | 10 2006 018 757 | A1 | 10/2007 | |
| DE | 10 2008 025 548 | A1 | 12/2009 | |
| EP | 1 095 720 | A1 | 5/2001 | |
| WO | WO 2007/042170 | A1 * | 4/2007 | B22D 11/18 |
| WO | WO 2010/149419 | A1 | 12/2010 | |
| WO | WO 2014/177605 | A1 | 11/2014 | |

OTHER PUBLICATIONS

Written Opinion dated Feb. 7, 2018 in corresponding PCT International Application No. PCT/EP2017/081615.
Search Report dated Nov. 2, 2017 in corresponding Austrian Patent Application No. A 51133/2016.
Chinese Office Action, dated Sep. 16, 2020, issued in corresponding Chinese Patent Application No. 201780077251.1. English translation. Total 12 pages.

* cited by examiner

METHOD AND DEVICE FOR REGULATING A CONTINUOUS CASTING MACHINE

CROSS-REFERENCE TO RELATED APPLICATIONS

The present application is a 35 U.S.C. §§ 371 national phase conversion of PCT/EP2017/081615, filed Dec. 6, 2017, the contents of which are incorporated herein by reference which claims priority of Austria Patent Application No. A51133/2016, filed Dec. 13, 2016, the contents of which are incorporated by reference herein. The PCT International Application was published in the German language.

TECHNICAL AREA

The present invention relates to a method for regulating a continuous casting machine, which machine comprises a mold and a strand guide downstream of the mold. Liquid metal is poured into the mold, in particular via an inflow unit. The liquid metal solidifies on walls of the mold so that a metal strand having a solidified strand shell and a still liquid core forms.

The metal strand is drawn out of the mold by means of rollers of the strand guide arranged spaced apart, wherein a measured variable is determined, which correlates with the variation of the casting level forming in the mold. This measured variable is processed with incorporation of at least one computation rule and is used to reduce the variations of the casting level. The invention also comprises a corresponding device.

The method can be used in continuous strand casting. In general, the method can be advantageously applied in all strand casting methods having high casting speeds, because a highly dynamic regulation/control of the casting level is increasingly required here.

PRIOR ART

In continuous strand casting, it is generally of great significance from a metallurgical aspect for the formation of a uniform, crack-free strand shell and a homogeneous, fault-free slab wherein casting level variations are within a required narrow tolerance range.

Because of various phenomena which influence the casting level, regulation is necessary to keep it constant. These phenomena include 1. Transient flows into the mold via the inflow unit:
   - clogging of the inflow unit, which can be designed as a plug or slide, clogging of the immersion pipe or the detaching and flushing free of these clogs,
   - changes of the flushing gas quantity (in the event of clogs, argon is usually injected into the clog's center to generate an overpressure in the immersion pipe (preventing the aspiration of air), which can cause turbulence in the steel bath in the mold),
   - distributor weight variations caused, for example, by non-ideal regulation of the inflow of the ladle in the distributor (distributor=intermediate vessel between ladle and mold). Due to this pressure change, a different flow rate is generated with equal plug opening, which has to be counteracted by regulation,
   - viscosity change of the steel in the event of, for example, ladle change.
2. Change of the volume of liquid steel in the mold:
   - format change in the mold
   - casting level target value change (for example, to reduce appearances of wear on the immersion pipe)
3. Transient flows out of the mold:
   - bulging
   - casting speed changes
   - bent rollers
   - intentional changes of the casting gap (for example, soft reduction)

All of these listed phenomena result in changes of the casting level and these changes have to be counteracted. Since many of the phenomena occur very suddenly and unexpectedly, the dynamic range of the regulation plays a very large role.

For special steel qualities, for example, peritectic steels or ferritic rustproof steels, irregularly occurring raising and lowering of the bath level (=cyclic) increasingly occurs during the continuous strand casting procedure, which is known as "bulging" or "mold level hunting". During the bulging, a determinable relationship can be established between a measured variable correlating with the bulging and the casting level movement. It is a feature of this cyclically occurring disturbance that it takes place in the case of a specific casting speed at a period duration which approximately corresponds to the average roller division (i.e., the spacing of the rollers in the transportation direction of the strand) of at least one region of the strand guide. The bulging occurs to a particular extent in continuous casting machines in which the roller division in the strand guide is constant over long portions (i.e., multiple successive rollers in the transportation direction of the strand have equal spacing in relation to one another). In addition to the fundamental wave, harmonic waves also occur. It has been possible to establish that the bulging only occurs above a critical casting speed to be determined empirically, which is in turn dependent on the equipment used and on the operating mode. However, a restriction of the casting speed is not acceptable from the aspect of a continuous trend toward capacity increases.

A regulating method for damping the bath or casting level variations is already known, for example, from DE 102 14 497 A1. In this method, the power consumption is measured at one or more driver rollers and the power consumption measured values are taken into consideration as the correction value for the quantity regulation during the feed of the metal melt from the intermediate vessel into the strand casting mold, by the power consumption measured value being added into a control loop as a disturbance variable. Changes in the power consumption which are induced, for example, by a change of the casting speed, or cyclically repeating disturbances of the power consumption values, for example, induced by roller impacts of driver rollers running out of true, are filtered out beforehand from the measured power consumption signal. However, the described regulating method is not capable of compensating for, for example, input dead times, so that always only a part of the bath level movements to be attributed to the bulging can be remedied.

A regulating method for the casting level of a continuous casting machine is known from patent application A 50301/2016, where the height of the casting level, the target value for the height of the casting level and further signals and the preliminary or a final target position are supplied to a regulator and the regulator determines a compensation value, which is added to the preliminary target position, so that the final target position, on the basis of which a manipulated variable for the inflow unit of the mold is determined in conjunction with the actual setting of the inflow unit, corresponds to the preliminary target position corrected by the compensation value.

A regulating method is known from WO 2010/149 419 A1, where the observer comprises a model of the strand casting mold, by means of which the observer determines an expected value for the casting level. The observer has a number of oscillation compensators, by means of which an interference component related to a respective interfering frequency is determined in each case on the basis of the difference of the height of the casting level from the expected value. The total of the interference components corresponds to the compensation value.

In the cited publications, the regulation of the casting level is implemented by the setting of the inflow unit of the mold, which only has a low dynamic range. It is therefore not possible, for example, to offset the frequencies of greater than or equal to 0.6 Hz, which occur in continuous strand casting from a speed of greater than or equal to 2 m/min, and which cause irregularities in the steel product and thus reduce the quality of the product. The problem of "high-frequency bulging", i.e., the bulging compensation of the bulging at frequencies greater than or equal to 0.6 Hz, has heretofore not been solved in the documents of the prior art.

OBJECT OF THE INVENTION

It is therefore an object of the present invention to overcome the disadvantages of the prior art and to propose a method for regulating a continuous casting machine, by means of which a higher dynamic range and a better quality of the casting level can be achieved. In particular, it should also be possible that oscillations of the bulging can be offset in a frequency range greater than or equal to 0.6 Hz using the method.

DESCRIPTION OF THE INVENTION

This object is achieved according to the invention by a method for regulating a continuous casting machine, wherein the continuous casting machine comprises a mold and a strand guide downstream of the mold, the liquid metal is poured into the mold, in particular via an inflow unit, which liquid metal solidifies on walls of the mold so that a metal strand having a solidified strand shell and a still liquid core forms, the metal strand is drawn out of the mold by means of rollers of the strand guide arranged spaced apart.

A measured variable is determined, which correlates with the variation of the casting level forming in the mold. This measured variable is processed with incorporation of at least one computation rule and is used to reduce the variations of the casting level. It is provided in this case that to reduce the variations of the casting level, the mutual spacing of opposing rollers of the strand guide is cyclically changed before the complete solidification point.

A movement which adjusts out the variations is thus effectuated by the computation rule by means of the adjusted rollers of the strand guide. The mutual spacing of opposing rollers, between which the strand is guided, has a direct effect on the liquid core of the strand and directly changes the casting level, the variations of the casting level are immediately corrected. A more accurate and dynamic regulation of the casting level is thus enabled. Smaller variations of the casting level in turn effectuate a quality improvement of the strand and/or the slab final product, for example, a reduction of inclusions or an avoidance of cracks. Therefore, in-phase oscillations having higher frequencies can also be generated by changes of the roller spacing. The movement of the inflow unit, in contrast, which establishes the quantity of liquid metal which enters the mold, is transmitted more slowly to the casting level, because liquid metal located below the inflow unit still flows into the mold when the position of the inflow unit is changed. An in-phase change of the position of the inflow unit can therefore only be achieved at lower frequencies using the inflow unit and/or only a lower regulating quality can be achieved by this additional dynamic range, which cannot be offset.

According to the invention, a control and/or regulation of the casting level can be achieved by the change of the mutual spacing of opposing rollers. The strand is located between opposing rollers.

The method only requires adjustable rollers which are arranged before the complete solidification point. The complete solidification point is, viewed along the strand guide, the location where the core of the strand or the slab is already solid. A regulation or control of the casting level is only possible before the complete solidification, however, i.e., where the strand or the slab is still liquid in the core. The rollers, the mutual spacing of which is changed to reduce the variations of the casting level, can be, but do not have to be, the rollers which are driven to draw the metal strand out of the mold.

The mutual spacing of opposing rollers of the strand guide is cyclically changed according to the invention. "Cyclically changed" means that opposing rollers periodically change the mutual spacing thereof in relation to one another.

In this case, the method according to the invention can be used as the single regulation and/or control method for the casting level (in combination with the flow rate regulation of the inflow unit), or also in combination with other regulation and/or control methods for the casting level by the inflow unit. In the case of a combination of regulation and/or control methods, the individual regulation and/or control methods can be operated independently of one another.

In particular if the bulging is (also) to be offset, the cyclic changes can be in a frequency range up to greater than or equal to 0.6 Hz, preferably up to 5 Hz. The change of the roller spacing can thus take place at frequencies which are also greater than or equal to 0.6 Hz, and which are in particular up to 5 Hz.

Thus, for example, if only the regulation and/or control method acting on the rollers is applied, the cyclic changes of the roller spacing can be in the frequency range from 0 to 0.6 Hz, 0 to 1 Hz, 0 to 2 Hz, 0 to 3 Hz, 0 to 4 Hz, or 0 to 5 Hz. If the regulation and/or control method according to the invention for reducing the variations of the casting level is combined with other regulation and/or control methods for reducing the variations of the casting level, for example, with the regulation method mentioned at the outset using the inflow unit of the mold, the other method or methods could thus cover a lower frequency range (for example, of 0 to 0.6 Hz), while the method according to the invention only covers the higher frequency range (for example, from 0.6 to 1 Hz, 0.6 to 2 Hz, 0.6 to 3 Hz, 0.6 to 4 Hz, or 0.6 to 5 Hz).

In a further preferred embodiment variant of the method according to the invention, it is provided that multiple roller segments each having one or more rollers are arranged on both sides along the strand guide (i.e., opposing one another with respect to the strand), wherein at least one roller segment is adjusted normally in relation to the strand guide direction. The term roller segment also includes so-called grids, which are typically arranged directly below the mold. "Normally in relation to the strand guide direction" means any adjustment here which extends essentially normally in relation to the strand guide direction. This comprises both a pivot and also a parallel displacement of a roller segment. The strand guide is generally divided into multiple segments along the strand guide direction, each segment contains two opposing roller segments.

A roller segment arranged close to the mold is advantageously adjusted. It can thus be provided that at least one roller segment of the first segment is adjusted. It can thus be provided that the uppermost roller segment, i.e., the one located closest to the mold, is adjusted. The greatest amplification of the actuator, which engages directly, enables the highest dynamic range. The factor with respect to the change of the roller spacing in the uppermost segment and its influence on the casting level is typically approximately 1:10 (pivotable segments) or 1:20 (segments moving in parallel). This means that a drop of the casting level in the mold around 1 mm or 2 mm, respectively, is effectuated by an increase of the roller spacing by 0.1 mm. In this way, only very small changes of the roller spacing are necessary, which can be effectuated in a very short time to be able to compensate for high frequencies of the bulging of up to 5 Hz.

Due to the selective adjustment of individual roller segments each having multiple rollers normally in relation to the strand guide direction, the spacing between rollers situated opposite to one another is reduced in opposition to the variations of the casting level to offset frequencies of the variations of the casting level. Due to this compensation, the stability of the continuous strand casting is significantly increased and high casting speeds are enabled with uniform quality of the steel product.

According to one preferred embodiment variant of the method according to the invention, it is provided that at least one roller segment is pivoted. The pivot axis is preferably closer to the mold in this case, so that the part of the roller segment more remote from the mold is deflected more strongly.

The outer roller segment, i.e., the one on the outwardly curved side of the strand guide, could be fixed in this case, for example, it could be implemented by a stationary outer frame. The opposing roller segment, i.e., the one on the inwardly curved side of the strand guide, is pivoted. It has an inner frame for this purpose, for example, which carries the rollers and is pivotably mounted. It would also be conceivable that the inner roller segment is fixedly attached and the outer roller segment is pivoted in relation to the inner roller segment.

Alternatively to the pivoting of roller segments, it can be provided that at least one roller segment is adjusted in parallel alignment in relation to an opposing roller segment arranged along the strand guide, whereby again a selective adaptation of the roller spacing between individual roller segments and rollers is enabled. The outer roller segment, i.e., the one on the outwardly curved side of the strand guide, could be fixed in this case, for example, it could be implemented by a stationary outer frame. The opposing roller segment, i.e., the one on the inwardly curved side of the strand guide, is then translationally displaced in the direction of the outer roller segment. It would also be conceivable here that, vice versa, the inner roller segment is fixed, while the opposing outer roller segment is translationally displaced.

The volume of liquid metal in the core of the strand can be determined by the spacing of the rollers of two opposing roller segments and an inference can thus be drawn about a relative casting level change.

According to one particularly preferred embodiment variant of the method according to the invention, at least one roller segment is adjusted by an adjustment device, which comprises at least one hydraulic or electromechanical actuator (for example, hydraulic cylinder or electrical spindle drive). To enable an optimum reaction time with respect to the setting of the roller spacing in regard to casting level variations, a proportional valve is preferably used for at least one hydraulic cylinder.

One embodiment of the invention provides that one or more frequencies of the variations of the casting level in a frequency range from 0 to 5 Hz are detected, preferably simultaneously, and the variations are offset by means of cyclic opposing change of the roller spacing of rollers of the strand guide.

An alternative embodiment of the invention provides that one or more frequencies of the variations of the casting level in a first frequency range are detected, preferably simultaneously, and the variations are offset by means of cyclic opposing movements of the inflow unit (of the mold). Further frequencies of the variations of the casting level in a second frequency range are detected and the variations are offset by means of cyclic opposing change of the roller spacing of rollers of the strand guide, wherein the second frequency range is greater than the first frequency range.

This embodiment variant has the advantage that lower-frequency variations of the casting level can be offset by regulating the inflow unit of the mold, as previously, while only the higher-frequency variations of the casting level are offset by the regulation of the spacing of the rollers. The possibility thus exists of retrofitting existing regulators for the lower-frequency variations with an additional regulator of the spacing of the rollers.

In this case, either the regulation for the inflow unit and/or the regulation for the roller spacing could be implemented with the aid of a so-called observer, as is disclosed in A 50301/2016. According to regulating technology, an observer is understood as a system which reconstructs non-measurable variables (states) from known input variables (for example, manipulated variables or measurable disturbance variables) and output variables (measured variables) of an observed reference system. For this purpose, it simulates the observed reference system as a model and tracks the measurable state variables, which are therefore comparable to the reference system, using a regulator. A model is thus prevented from generating errors which grow over time.

The method variant having two frequency ranges preferably comprises a first observer, which determines a first compensation value for a target position of the inflow unit on the basis of frequencies of the first frequency range, and a second observer, which determines a second compensation value for the roller spacing of the rollers of the strand guide on the basis of frequencies of the second frequency range.

In this way, the casting level in the mold is regulated both by the inflow into the mold and also by the guiding of the metal strand, preferably in the uppermost segment, after the mold. In addition, it is advantageous that due to the separation of the observers onto various actuators (on the one hand, the first compensation value for the target position of the inflow unit in the case of the first observer and, on the other hand, the second compensation value for the roller spacing of the rollers of the strand guide), no interference between the observers and/or no negative influencing of the observers among one another can occur.

In one particularly preferred embodiment variant of the method having two frequency ranges, the first observer operates in a frequency range less than or equal to 0.6 Hz and the second observer operates in a frequency range greater than or equal to 0.6 Hz, preferably between 0.6 and 5 Hz. The advantage results due to the separated frequency ranges of the two observers that interference cannot occur between the observers due to overlap of the frequency windows, whereby, for example, the target value for the actuator of the casting level regulation remains equal to (in the case of no bulges) or less than in the case without secondary compensation. In this way, casting level variations are additionally reduced and quality losses of the steel product are greatly decreased. In addition, it is to be noted that no method is previously known in the prior art which can compensate for frequencies of the variations of the casting level of greater than or equal to 0.6 Hz, because of which due to the use of the method according to the invention, high casting speeds can be used with high quality of the steel product, whereby the productivity of plants for continuous strand casting or for continuous strip production are significantly increased.

One possible device for carrying out the method according to the invention comprises means for introducing a metal melt into a mold, a strand guide comprising rollers, and a measuring unit for measuring variations of the casting level, which is connected to a control unit. In this case, an adjustment device connected to the control unit is provided, which is designed to reduce, in particular offset variations of the casting level by cyclic change of the roller spacing, opposing the variations of the casting level, of opposing rollers of the strand guide.

As already mentioned in conjunction with the method, it can be provided that the adjustment device is designed for cyclic changes of the roller spacing in a frequency range up to greater than or equal to 0.6 Hz, preferably up to 5 Hz. The adjustment device can comprise at least one hydraulic or electromechanical actuator, such as a hydraulic cylinder or an electrical spindle drive. Of course, the adjustment device can be designed for cyclic changes of the roller spacing in a frequency range from 0 Hz, preferably up to 5 Hz, for example, also using hydraulic or electromechanical actuators, such as a hydraulic cylinder or an electrical spindle drive.

As also already mentioned in conjunction with the method, it can be provided that multiple roller segments each having one or more rollers are arranged on both sides along the strand guide, wherein at least one roller segment is adjustable by means of the adjustment device normally in relation to the strand guide direction.

For example, at least one roller segment can be adjustable in the uppermost, i.e., first segment. In this case, at least one roller segment can be pivotable, or at least one roller segment is adjustable in parallel alignment in relation to an opposing roller segment arranged along the strand guide. The roller segments are preferably adjusted in such a way that no sudden segment transitions (=thickness changes) arise, this is referred to as a "linked method".

In accordance with the method variant having two frequency ranges, one variant of the device according to the invention provides that one or more frequencies of the variations of the casting level in a first frequency range are detectable, preferably simultaneously, by means of the measuring unit, and these variations can be offset by means of cyclic opposing movements of an inflow unit of the mold, and further frequencies of the variations of the casting level in a second frequency range are detectable by means of the measuring unit and these variations can be offset by means of cyclic opposing change of the roller spacing of rollers of the strand guide by means of the adjustment device, wherein the second frequency range is greater than the first frequency range.

This can again be executed, for example, by means of a first and/or a second observer. The second observer comprises the same components as the first observer and functions similarly, with the difference that it specifies a second compensation value, not the inflow unit for the mold, but rather the adjustment device which is located preferably in the uppermost segment of the strand guide.

The method according to the invention or the device according to the invention is applicable to existing continuous casting machines having the above-mentioned requirements and represents a significant improvement of the quality of continuously cast steel with a significantly higher casting speed and thus increased productivity. Suppressing highly dynamic effects, which heretofore could not be adjusted out, is enabled by this new type of casting level regulation, for example, highly dynamic bulging at frequencies greater than 0.6 Hz.

BRIEF DESCRIPTION OF THE FIGURES

The invention will be explained in greater detail on the basis of an exemplary embodiment. The drawings are exemplary and are to illustrate the concept of the invention, but are in no way to restrict it or even reproduce it exhaustively.

BRIEF DESCRIPTION OF THE DRAWINGS

Figure 1:
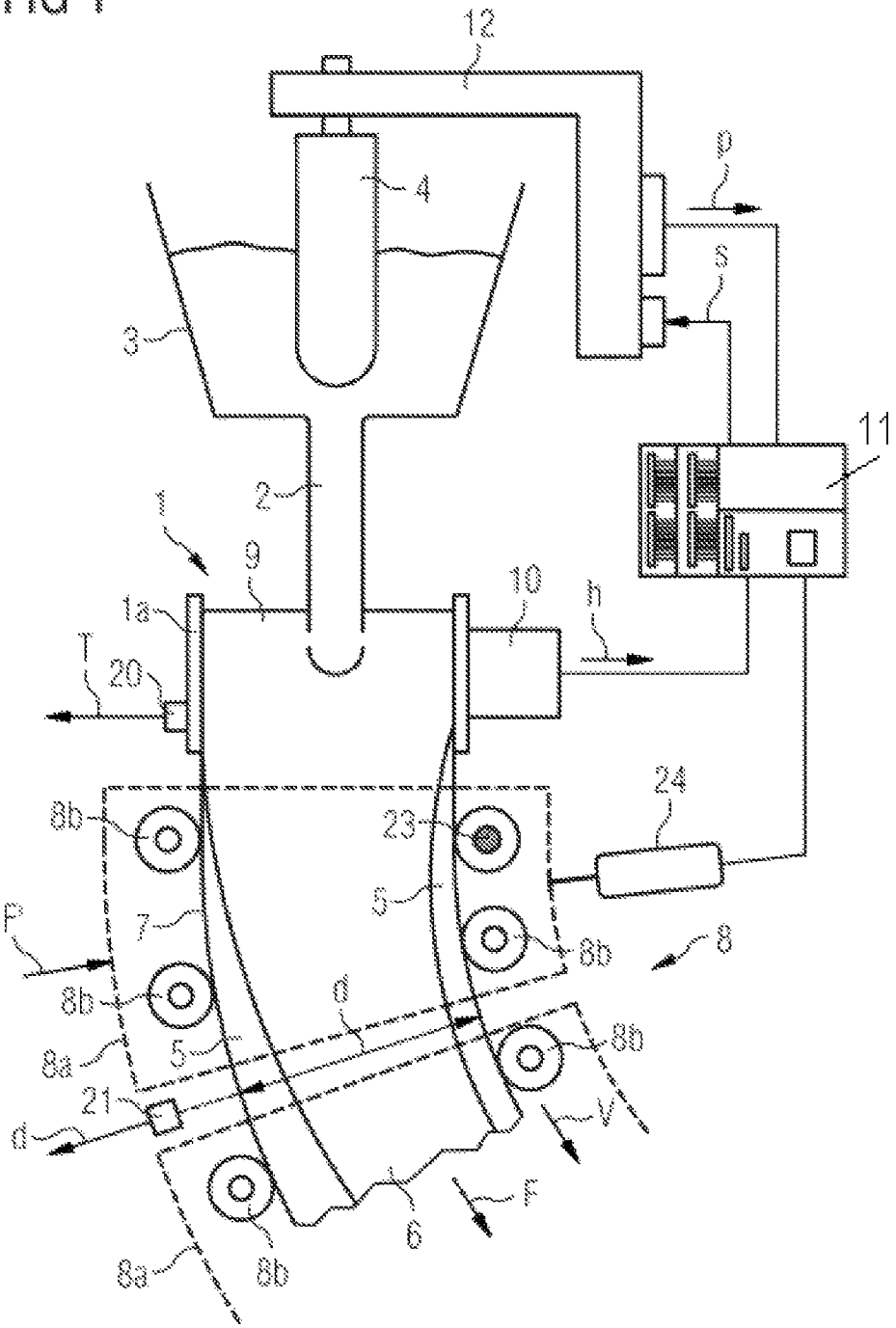
Figure 2:
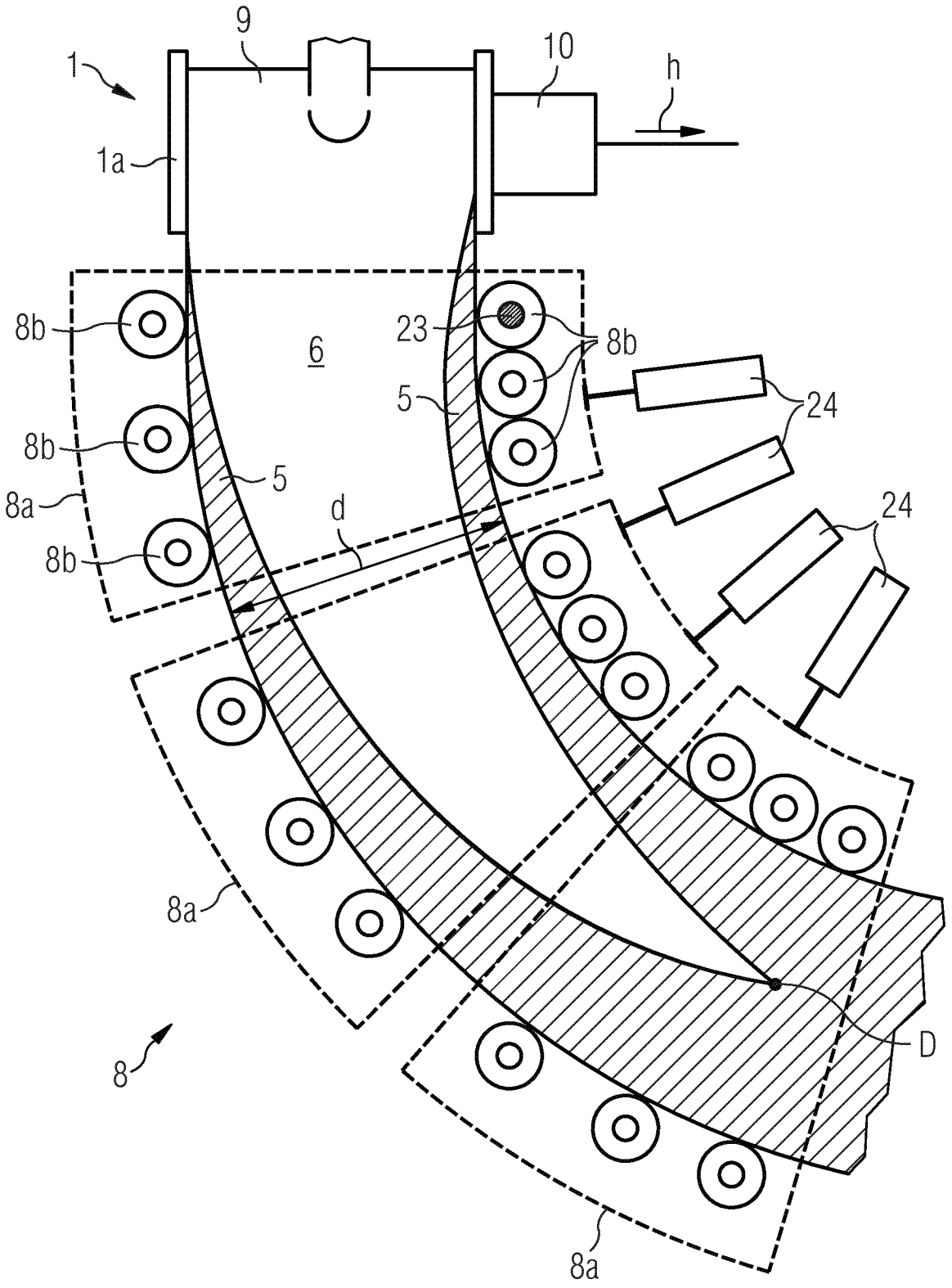
Figure 3:
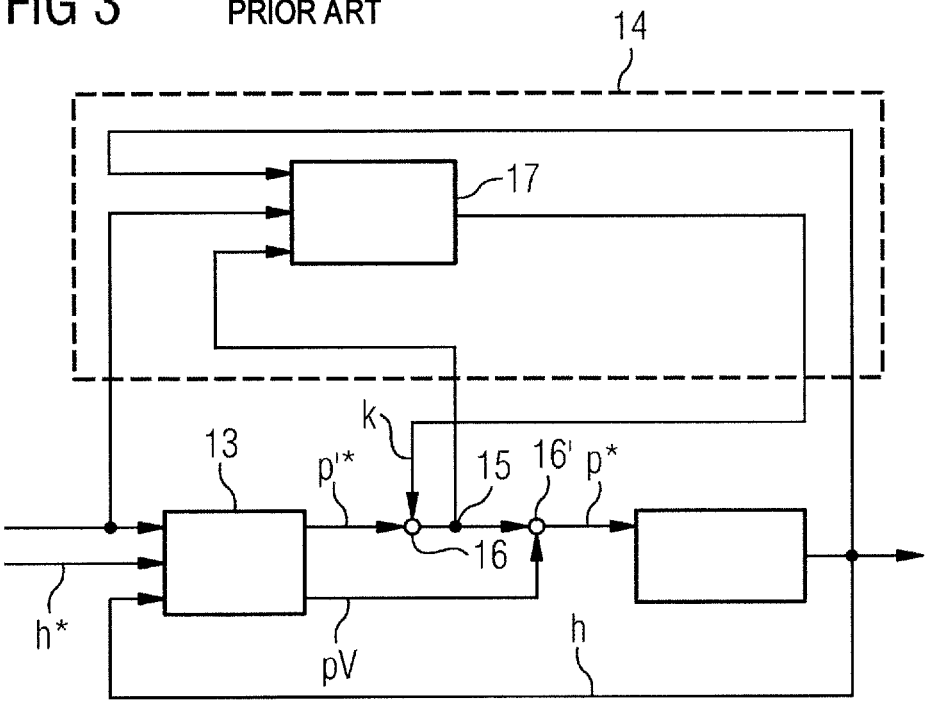
FIG 3 PRIOR ART
Figure 4:
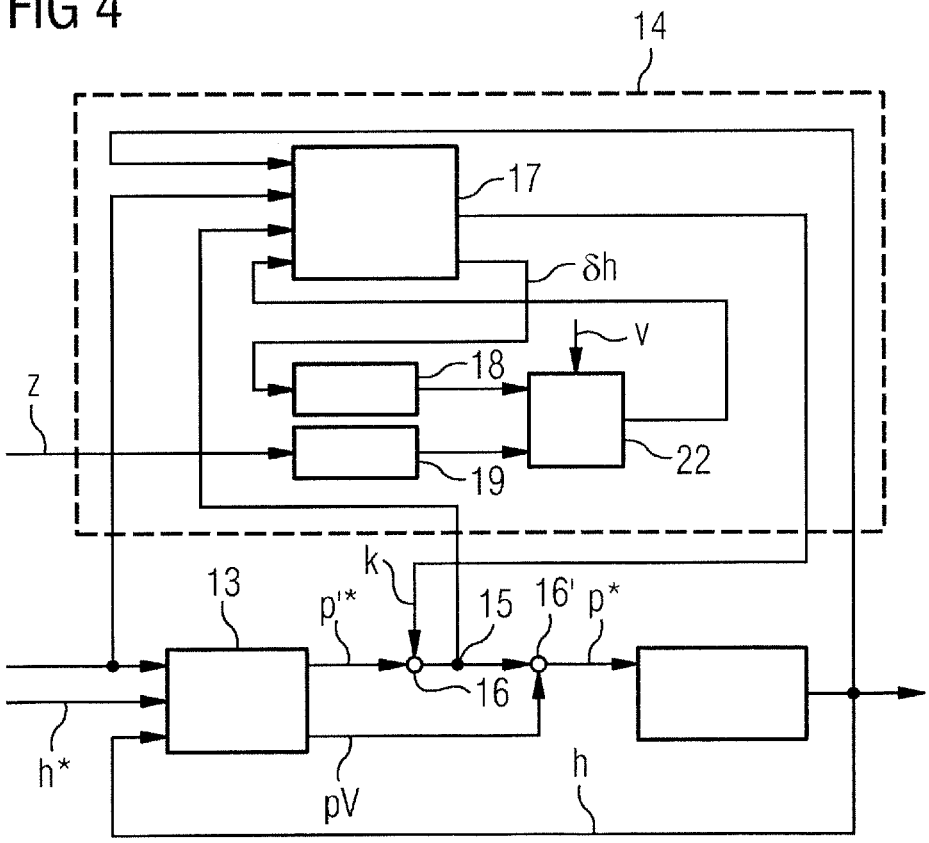
Figure 5:
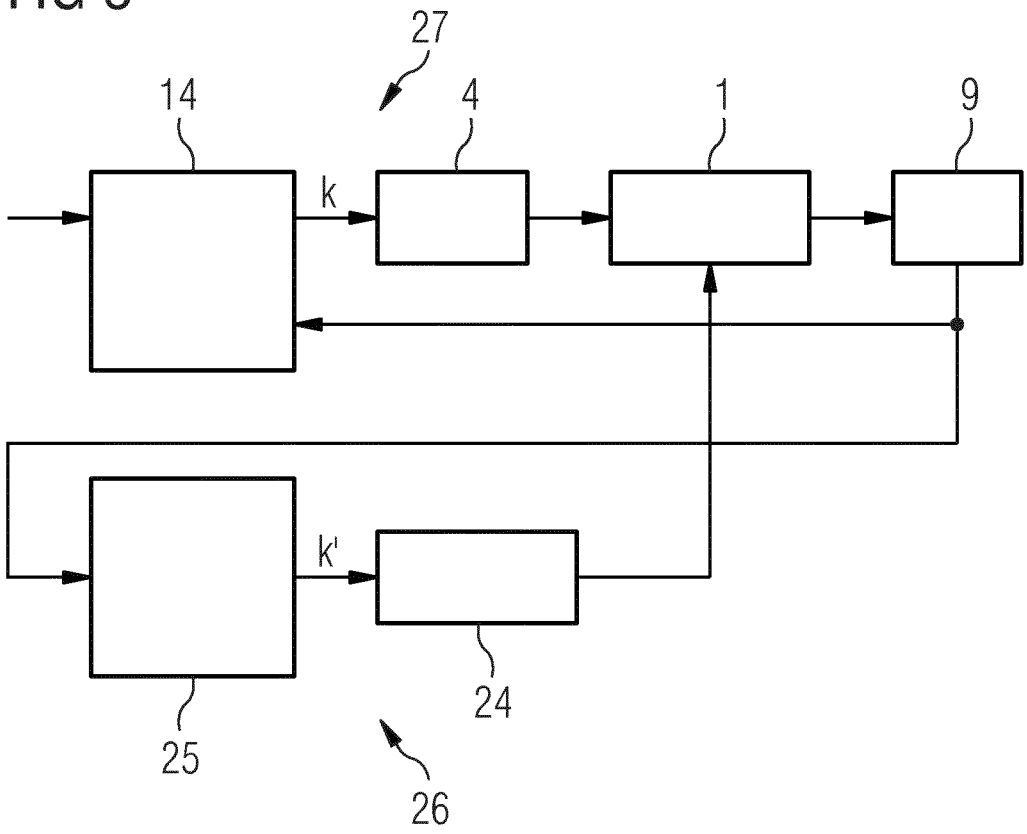
Figure 6:
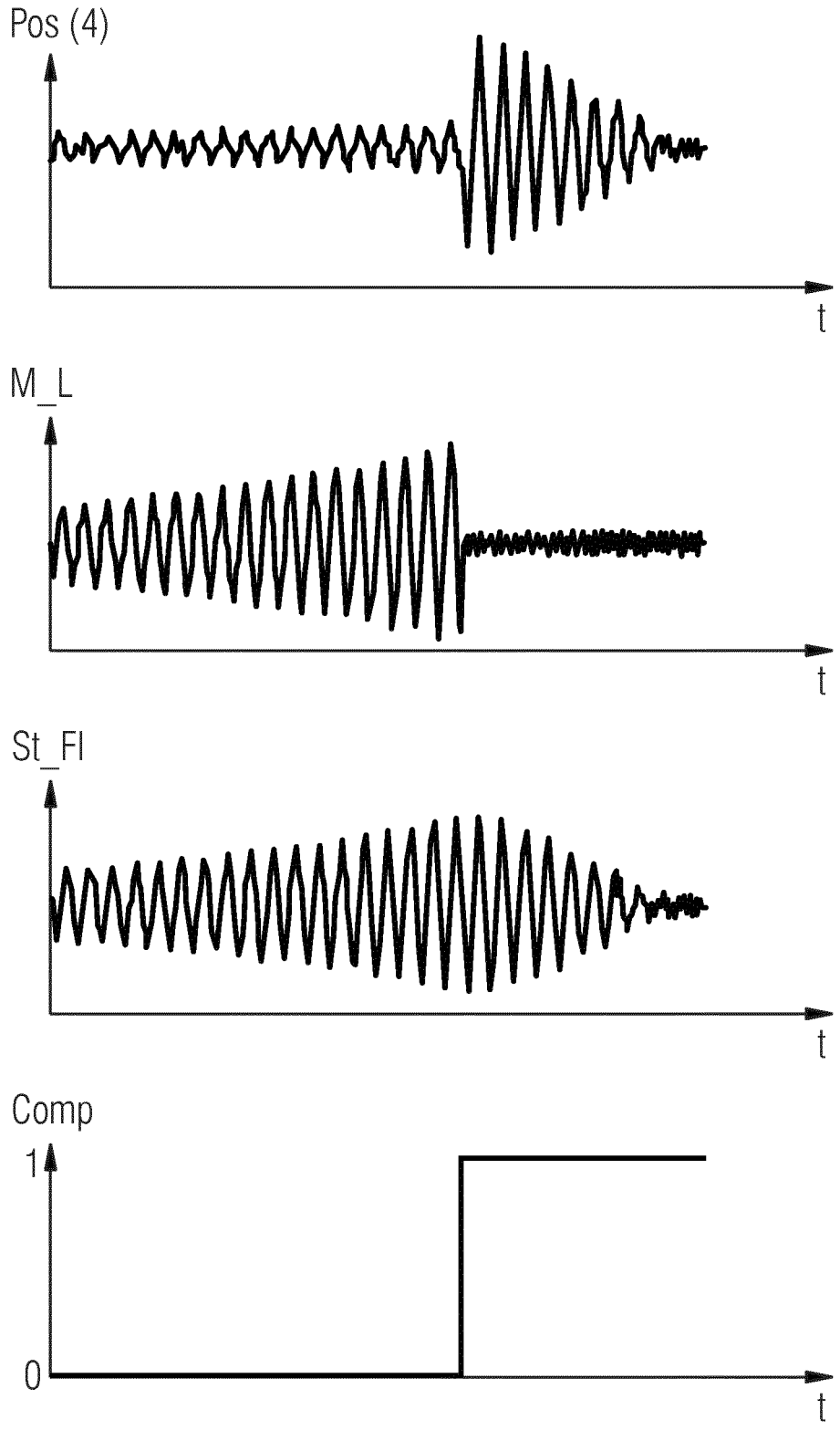

FIG. 1 shows a schematic view of a portion of a continuous casing machine according to the invention, FIG. 2 shows a schematic view of a strand guide according to the invention, FIG. 3 shows the schematic construction of a control unit of the prior art, FIG. 4 shows details of the first observer from FIG. 3, FIG. 5 schematically shows a monitoring loop according to the invention comprising a first and second observer, FIG. 6 shows the time curve of various variables during the regulation of a continuous casting machine.

EMBODIMENT OF THE INVENTION

According to FIG. 1, a continuous casting machine comprises a mold 1. Liquid metal 3, for example, liquid steel or liquid aluminum is poured into the mold 1 via an immersion pipe 2. The inflow of the liquid metal 3 into the mold 1 is set by means of an inflow unit 4. A design of the inflow unit 4 as a closure plug is illustrated in FIG. 1. In this case, a position p of the inflow unit 4 corresponds to a stroke position of the closure plug. Alternatively, the inflow unit 4 can be designed as a slide. In this case, the closure position p corresponds to the slide position.

The liquid metal 3 located in the mold is cooled by means of cooling units (not shown), so that it solidifies on walls la of the mold 1 and thus forms a strand shell. A core 6 is still liquid, however. It solidifies only later. The strand shell 5 and the core 6 together form a metal strand 7. The metal strand 7 is supported and drawn out of the mold 1 by means of a strand guide 8. The strand guide 8 is downstream of the mold 1. It comprises multiple roller segments 8*a*, which in turn comprise rollers 8*b*. Only a few are shown of the roller segments 8*a* and the rollers 8*b* in FIG. 1. The metal strand 7 is drawn at a draw-off speed v out of the mold 1 by means of the rollers 8*b*.

The liquid metal 3 forms a casting level 9 in the mold 1. The casting level 9 is to be kept as constant as possible. Therefore, both in the prior art and also in the present embodiment variant of the invention, the position p of the inflow unit 4 is tracked to set the inflow of the liquid metal 3 into the mold 1 accordingly. A height h of the casting level 9 is detected by means of a measuring unit 10 (known per se). The height h is supplied to a control unit 11 for the continuous casting machine. The control unit 11 determines a manipulated variable S for the inflow unit 4 according to a regulating method, which is explained in greater detail hereafter. The inflow unit 4 is then activated accordingly by the control unit 11. In general, the control unit 11 outputs the manipulated variable S to an adjustment unit 12 for the inflow unit 4. The adjustment unit 12 can be, for example, a hydraulic cylinder unit. Frequencies of the bulging after the mold are detected metrologically and/or determined according to $f=v_c/p_{Roll}*n$, wherein $v_c$ corresponds to the draw-off speed of the strand, f corresponds to the bulging frequency, n corresponds to the number of the harmonic frequencies (1, 2, etc.), and $p_{Roll}$ corresponds to the roller spacings.

The roller spacings, which correspond to the strand thickness d shown, can be intentionally adapted by means of pivot axis 23 and/or adjustment device 24. This can take place, as shown here in FIG. 1, in that in the first segment at least one roller segment 8*a* comprises a fixed outer frame, for example, the roller segment 8*a* located on the left directly below the mold 1 here. The opposing roller segment 8*a*, and/or the inner frame supporting it, is pivotable around a pivot axis 23, which extends normally in relation to the plane of the drawing. The pivot axis 23 can coincide with a rotational axis of a roller 8*b*, with the rotational axis of the upper roller 8*b* here, but could also be provided at another point, of course. Due to the pivoting, the roller spacing changes in the lower roller pair of the uppermost roller segment 8*a* in FIG. 1, while the roller spacing of the upper roller pair remains the same. This is not disadvantageous because the change of the roller spacing due to the method according to the invention is generally only in the range of a few tenths of millimeters up to 2 mm.

Possible guide rollers, which are directly connected to the mold and would be arranged above the uppermost roller segment 8*a* shown here, are not shown in FIG. 1. These guide rollers are generally not adjustable in relation to one another and normally in relation to the strand guide direction, however.

As an alternative to the pivoting, the left uppermost roller segment 8*a*, i.e., for example, its outer frame, could be fixed and the right upper roller segment 8*a*, i.e., for example, its inner frame, could be displaced in parallel normally to the strand guide direction toward the left roller segment 8*a* and away from it. The roller spacing of all roller pairs thus changes by the same absolute value in each case. This could also be carried out using one or more hydraulic cylinders (distributed along the strand width and/or along the strand guide direction).

In FIG. 2, only one strand guide 8 is shown, which can replace the strand guide 8 in FIG. 1 or also supplement it, after the uppermost segment. In FIG. 2, in each of the three illustrated segments, each roller segment 8*a* has three rollers 8*b* on each side. However, there could also be only two or more than three rollers 8*b* per roller segment 8*a*. In continuation of FIG. 1, the fixed strand shell 5 and the liquid core 6 of the strand are illustrated here up to the complete solidification point D. Accordingly, adjustment devices 24 are also provided in all segments 8*a* up to the complete solidification point D. The adjustment devices 24 can adjust each of the roller segments 8*a* by pivoting or by parallel displacement, as already explained in FIG. 1. In this example, the inner roller segment 8*a* of the first (uppermost) segment is adjusted by pivoting around the pivot axis 23, and the inner roller segment 8*a* of the second segment is adjusted by parallel displacement by means of two adjustment devices 24. The connection of the adjustment devices 24 to the control unit 11 is not shown here.

In FIG. 3, the control unit 11 implements inter alia, a casting level regulator 13. The height h of the casting level 9 is supplied to the casting level regulator 13. Furthermore, a target value h* for the height h of the casting level 9 is supplied to the casting level regulator 13. Furthermore, further signals are supplied to the casting level regulator 13. The further signals can be, for example, the width and the thickness of the cast metal strand 7 (or more generally the cross section of the metal strand 7), the draw-off speed v (or its target value), and others. The casting level regulator 13 then determines on the basis of the deviation of the height h of the casting level 9 from the target value h* in particular a preliminary target position p'* for the inflow unit 4. The casting level regulator 13 can use the further signals for its parameterization and/or for determining a pilot control signal pV.

The control unit 11 furthermore implements a first observer 14. The height h of the casting level 9 and its target value h*, the further signals and a final target position p* for the inflow unit 4 are supplied to the first observer 14. The first observer 14 determines a first compensation value k. The first compensation value k is added to the preliminary target position p'* and the final target position p* is thus determined. The manipulated variable S activates the inflow unit 4, and that variable is then determined on the basis of the deviation of the actual setting p from the final target position p*. In general, the control unit 11 implements a lower-order position regulator (not shown) for this purpose.

For the sake of good order, the first and second observers 14, 25 are not persons, but rather function blocks implemented in the control unit 11.

The difference between the preliminary target position p'* and the final target position p* corresponds to the first compensation value k determined by the first observer 14. Since the first compensation value k is determined by the first observer 14 and it is therefore known to the first observer 14, alternatively to the final target position p*, the preliminary target position p'* can also be supplied to the first observer 14. Because of the circumstance that the first compensation value k is known to the first observer 14, the first observer 14 can thus readily determine the final target position p* from the preliminary target position p'*. A tapping point 15, at which the (preliminary or final) target position p'*, p* is tapped can thus be located before or after a node point 16 as needed, at which the first compensation value k is added to the preliminary target position p'*. The tapping point 15 is to be located before a node point 16', however, at which the pilot control signal pV is added on.

The first observer 14 comprises a determination block 17. The height h of the casting level 9, the further signals, and the final target position p* are supplied to the determination block 17. The determination block 17 comprises a model of the continuous casting machine. By means of the model, the determination block 17 determines on the basis of the further signals and the final target position p* an expected height (i.e., computed with model support) for the casting level 9. On the basis of the expected height, the determination block 17 then determines an expected variation value δh (i.e., computed with model support) for the height h of the casting level 9, i.e., the short-term variation. For example, the determination block 17 can perform averaging of the height h of the casting level 9 and subtract the resulting mean value from the expected height. The determined variation value δh thus reflects the expected variation of the height h of the casting level 9. On the basis of the variation value δh, the determination block 17 then determines the first compensation value k.

The procedure previously explained in conjunction with FIG. 3 corresponds to the procedure of the prior art. It is also used in this embodiment variant of the present invention. The first observer 14 having the determination block 17 is illustrated once again in FIG. 4. In the scope of the present invention, the determination block 17 is merely one of multiple components of the first observer 14 in accordance with the illustration in FIG. 4, however. Thus, for example, the first observer 14 additionally comprises a first analysis element 18. The variation value δh is supplied to the first analysis element 18. The first analysis element 18 determines the frequency components of the variation value δh therefrom. In addition, a second analysis element 19 is preferably also provided. A secondary signal Z is supplied to the second analysis element 19. The second analysis element 19 determines the frequency components of the secondary signal Z therefrom.

The secondary signal Z can be a withdrawal force F. Using that force, the metal strand 7 is withdrawn from the mold 1 by the rollers 8*b* of the strand guide 8. The withdrawal force F is oriented parallel to the draw-off speed v. Alternatively, it can be the draw-off speed v itself. These two alternatives are preferred. However, it is also possible, for example to use a force signal F', which is applied to (at least) one of the roller segments 8*a* of the strand guide 8, as the secondary signal Z. The direction to which the force signal F' is related is orthogonal to the draw-off speed v. The secondary signal Z can again alternatively be a local strand thickness d, which is measured by means of a measuring unit 21 in the strand guide 8. The first analysis element 18 supplies the frequency components determined thereby to a selection element 22. If it is provided, this also applies in a similar manner to the second analysis element 19. The selection element 22 determines, in conjunction with the draw-off speed v, the associated wavelengths which correspond to the frequency components of the variation value δh and possibly also of the secondary signal Z. The draw-off speed v is supplied for this purpose to the first observer 14 and to the selection element 22 within the first observer 14. The selection element 22 determines the wavelengths at which the associated frequency component of the variation value δh and possibly also the associated frequency component of the secondary signal Z is greater than a threshold value S1, S2. The respective threshold value S1, S2 can be defined individually for the frequency components of the variation value δh, on the one hand, and the frequency components of the secondary signal Z, on the other hand. These wavelengths are preselected by the selection element 22. Within ranges, which are each coherent per se, of preselected wavelengths of the variation value δh, the selection element 22 then determines the wavelengths λi (i=1, 2, 3, . . . ), at which the respective frequency component of the variation value δh assumes a maximum. The number of wavelengths λi is not restricted. The selection element 22 (finally) selects these wavelengths λi. The selection element 22 supplies the selected wavelengths λi to the determination block 17. The determination block 17 carries out a filtering of the height h of the casting level 9 and the final target position p* for the wavelengths λi selected by the selection element 22. The determination block determines the first compensation value k solely on the basis of the filtered height h of the casting level 9 and the filtered final target position p*. The determination block 17 leaves the other frequency components of the height h of the casting level 9 and the final target position p* unconsidered in the scope of the determination of the first compensation value k. Furthermore, predetermined wavelength ranges can be specified to the selection element 22. In this case, the predetermined wavelength ranges represent an additional selection criterion. In particular, wavelengths at which the associated frequency component of the variation value δh and possibly also the associated frequency component of the secondary signal Z are above the respective threshold value S1, S2 are only selected if they are additionally within one of the predetermined wavelength ranges. Otherwise, they are not selected even if the associated frequency component of the variation value δh and possibly also the associated frequency component of the secondary signal Z is greater than the respective threshold value S1, S2.

As already previously mentioned, the second observer 25 comprises identical components as the first observer 14, analyzes frequencies of the bulging after the mold 1, and specifies a second compensation value k' for the adjustment device 24. A monitoring loop is shown in FIG. 5, which comprises a first and a second observer 14, 25. The first observer 14 specifies a first compensation value k for the inflow unit 4 of the mold 1, whereby the casting level 9 in the mold 1 is regulated. Stated in simplified terms, the first observer 14 and the inflow unit 4 of the mold 1 together represent a standard system for regulating the casting level 9 of the mold 1, which is used for the compensation of frequencies in the first frequency range and thus represents a controller 27 for frequencies of the first frequency range. The second observer 25, which is connected to the adjustment device 24, represents a controller for frequencies of the second frequency range 26 and specifies a second compensation value k'.

Instead of the first observer 14, which controls and/or regulates the inflow unit 4 of the mold 1, another regulating method could be provided, and/or instead of the second observer 25, which controls and/or regulates the adjustment device 24 of the rollers 8*b*, another regulating method could be provided.

Only a single regulating method could also be provided, which only controls and/or regulates the adjustment device 24 of the rollers 8*b*, while the inflow unit 4 of the mold 1 is not used at all for adjusting out the variations of the casting level.

This single regulating method could be the second observer 25, or also another control or regulating method. In this case, the second observer or another single control or regulating method would generally cover a greater frequency range than in the case of two regulating methods. This frequency range could then cover, for example, the frequencies from 0 to 0.6 Hz, 0 to 1 Hz, 0 to 2 Hz, 0 to 3 Hz, 0 to 4 Hz, or 0 to 5 Hz.

FIG. 6 shows an example of a suppression of cyclic oscillations. The time t is plotted along the horizontal axis. The position of the inflow unit 4, inscribed with "Pos (4)", is illustrated along the vertical axis in the first (uppermost) illustration, in the second figure the height of the casting level in the mold 1, inscribed with "M_L", and in the third figure the steel flow from the mold 1, inscribed with "St_Fl". For better comprehension, the regulation "Comp" is still deactivated at the point in time t=0 and is then switched on, which is illustrated in the last figure with the states "0" for the deactivated regulation and "1" for the activated regulation. It is well recognizable in the first three illustrations that the position of the inflow unit 4 cyclically changes, and also the height of the casting level and as a result also the steel flow out of the mold. The cyclic variations of the casting level "M_L" are reduced with the activation of the regulation, by changing the position "Pos (4)" of the inflow unit 4 here. In the method according to the invention, additionally or alternatively to changing the position "Pos (4)" of the inflow unit 4, one would cyclically change the mutual spacing of the rollers 8*b* in the uppermost segment accordingly to reduce the variations of the casting level.

LIST OF REFERENCE SIGNS

1 mold
1*a* walls of the mold
2 immersion pipe
3 liquid metal
4 inflow unit
5 strand shell
6 core
7 metal strand
8 strand guide
8*a* roller segments
8*b* rollers
9 casting level
10 measuring unit
11 control unit
12 adjustment unit
13 casting level regulator
14 first observer
15 tapping point
16, 16' node points
17 determination block
18, 19 analysis elements
20 temperature sensor
21 measuring unit
22 selection element
23 pivot axis
24 adjustment device
25 second observer
26 controller for frequencies of the second frequency range
27 controller for frequencies of the first frequency range
D complete solidification point
d strand thickness
F withdrawal force
F' force signal
h height of the casting level
h* target value for the height of the casting level
k first compensation value
k' second compensation value
p position of the inflow unit
p*, p'* target positions
pV pilot control signal
S manipulated variable
S1, S2 threshold values
T temperature
v draw-off speed
Z secondary signal
δh variation value

The invention claimed is:

1. A method for regulating a continuous casting machine, wherein the continuous casting machine comprises a mold for forming a strand and a strand guide for guiding the strand and metal from the mold downstream of the mold;

the method comprising:

pouring liquid metal into the mold, via an inflow unit, wherein the liquid metal solidifies on walls of the mold, thereby forming a metal strand having a solidified strand shell and a still liquid core forming within the shell;

drawing the metal strand out of the mold by means of rollers of the strand guide, wherein the rollers are arranged spaced apart;

determining a measured variable correlated with cyclical variations of a casting level of liquid metal in the mold;

processing the measured variable with incorporation of at least one computing rule and using the at least one computing rule to reduce the cyclical variations of the casting level of the liquid metal in the mold; and reducing the cyclical variations of the casting level of the liquid metal in the mold by cyclically changing the mutual spacing of opposing rollers of the strand guide toward or away from the strand before a complete solidification point, whereby the cyclical variations of the casting level of the liquid metal in the mold are opposed by anti-cyclically changing the mutual spacing of opposing rollers of the strand guide toward or away from the strand.

2. The method as claimed in claim 1, wherein the cyclic changes are in a frequency range up to greater than or equal to 0.6 Hz.

3. The method as claimed in claim 1, further comprising: arranging multiple roller segments, each having one or more rollers, on both sides along the strand guide, and adjusting at least one roller segment normally in relation to a strand guide direction.

4. The method as claimed in claim 3, further comprising adjusting at least one roller segment of a first segment.

5. The method as claimed in claim 3, further comprising pivoting at least one roller segment.

6. The method as claimed in claim 3, further comprising adjusting at least one roller segment in parallel alignment in relation to an opposing roller segment.

7. The method as claimed in claim 1, further comprising adjusting at least one roller segment by an adjustment device, which comprises at least one electromechanical or hydraulic actuator.

8. The method as claimed in claim 1, further comprising detecting frequencies of the cyclic variations of the casting level in a frequency range from 0.6 to 5 Hz; and offsetting the cyclic variations by cyclic opposing change of the roller spacing of rollers of the strand guide.

9. The method as claimed in claim 1, further comprising detecting frequencies of first cyclic variations of the casting level in a first frequency range;

offsetting the first cyclic variations by cyclic opposing movements of the inflow unit;

detecting further frequencies of second cyclic variations of the casting level in a second frequency range; and offsetting the second cyclic variations by cyclic opposing change of the roller spacing of rollers of the strand guide, wherein the second frequency range is greater than the first frequency range.

10. A device for carrying out a method as claimed in claim 1, comprising:

means for introducing a metal melt into a mold, a strand guide comprising rollers;

a measuring unit for measuring the cyclic variations of the casting level; and an adjustment device connected to a control unit, the adjustment device is configured to reduce and compensate the cyclic variations of the casting level in the mold by anti-cyclic change of the roller spacing of opposing rollers of the strand guide toward or away from the strand for opposing the variations of the casting level.

11. The device as claimed in claim 10, wherein the adjustment device is configured for cyclic changes of the roller spacing in a frequency range up to greater than or equal to 0.6 Hz.

12. The device as claimed in claim 10, wherein the adjustment device comprises at least one hydraulic or electromechanical actuator.

13. The device as claimed in claim 10, wherein the rollers comprise multiple roller segments, each segment having one or more rollers, the roller segments are arranged on both sides along the strand guide, wherein at least one roller segment is adjustable in a direction normal in relation to a strand guide direction by means of the adjustment device.

14. The device as claimed in claim 13, wherein the at least one roller segment is a first roller segment.

15. The device as claimed in claim 13, wherein the at least one roller segment is pivotable.

16. The device as claimed in claim 13, wherein the at least one roller segment is adjustable in parallel alignment in relation to an opposing roller segment arranged along the strand guide.

17. The device as claimed in claim 10, wherein the measuring unit is configured and operable to detect frequencies of the cyclic variations of the casting level in a first frequency range;

an inflow unit of the mold is configured and operable to offset cyclic opposing movements of an inflow unit of the mold;

the measuring unit being configured and operable to detect further frequencies of the cyclic variations of the casting level in a second frequency range;

the cyclic variations of the first and second frequency ranges are offsettable by a cyclic opposing change of roller spacing of the rollers of the strand guide and by the adjustment device; and wherein the second frequency range is greater than the first frequency range.

* * * * *